US008098876B2

(12) United States Patent
Yamagishi

(10) Patent No.: US 8,098,876 B2
(45) Date of Patent: Jan. 17, 2012

(54) SPEAKER

(75) Inventor: Kiyoshi Yamagishi, Mie (JP)

(73) Assignee: Panasonic Corporation, Osaka (JP)

( * ) Notice: Subject to any disclaimer, the term of this patent is extended or adjusted under 35 U.S.C. 154(b) by 1289 days.

(21) Appl. No.: 11/667,112

(22) PCT Filed: Jan. 19, 2006

(86) PCT No.: PCT/JP2006/000689

§ 371 (c)(1),
(2), (4) Date: May 7, 2007

(87) PCT Pub. No.: WO2006/080221

PCT Pub. Date: Aug. 3, 2006

(65) Prior Publication Data

US 2008/0049966 A1 Feb. 28, 2008

(30) Foreign Application Priority Data

Jan. 31, 2005 (JP) ..... 2005-022421

(51) Int. Cl.
*H04R 25/00* (2006.01)

(52) U.S. Cl. ..... 381/396; 381/400; 381/407

(58) Field of Classification Search ..... 381/396–397, 381/400, 403, 407, 408

See application file for complete search history.

(56) References Cited

U.S. PATENT DOCUMENTS

| | | | | |
|---|---|---|---|---|
| 4,387,275 | A * | 6/1983 | Shimada et al. | 381/407 |
| 4,414,437 | A | 11/1983 | Trauernicht et al. | |
| 5,357,586 | A * | 10/1994 | Nordschow et al. | 381/397 |
| 6,327,371 | B1 * | 12/2001 | Proni | 381/397 |
| 6,672,423 | B2 * | 1/2004 | Kato | 181/161 |
| 7,185,735 | B2 * | 3/2007 | Sahyoun | 181/157 |
| 7,263,198 | B2 * | 8/2007 | Onuma | 381/403 |

FOREIGN PATENT DOCUMENTS

| | | |
|---|---|---|
| JP | 56-91598 | 7/1981 |
| JP | 59-072298 | 4/1984 |
| JP | 11-055790 | 2/1999 |
| JP | 2003-158792 | 5/2003 |

* cited by examiner

*Primary Examiner* — Suhan Ni

(74) *Attorney, Agent, or Firm* — Wenderoth, Lind & Ponack, L.L.P.

(57) ABSTRACT

A speaker includes a magnetic circuit 1 that is formed in the center of a frame 5, a voice coil 6 that is inserted in a magnetic gap of the magnetic circuit 1, a damper 7 that is fixed to the frame 5 and the voice coil 6, and a vibrating plate 8 that is fixed to the frame 5 and the voice coil 6. An opening 10 is provided in a bobbin 12 of the voice coil 6. The area of the opening 10 is 0.3% or less of the radial cross-sectional area of the bobbin 12 of the voice coil 6.

8 Claims, 2 Drawing Sheets

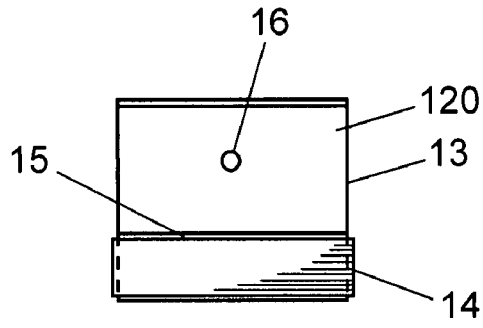
FIG. 3
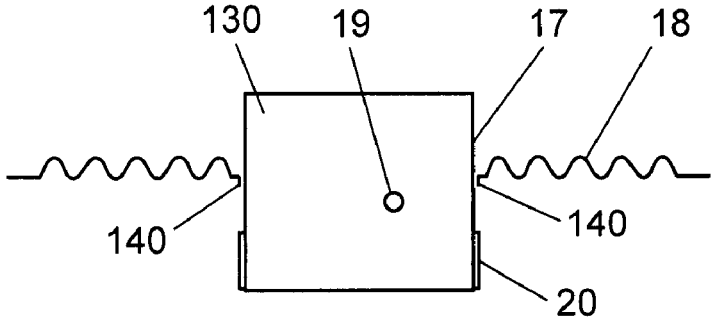
FIG. 4 PRIOR ART
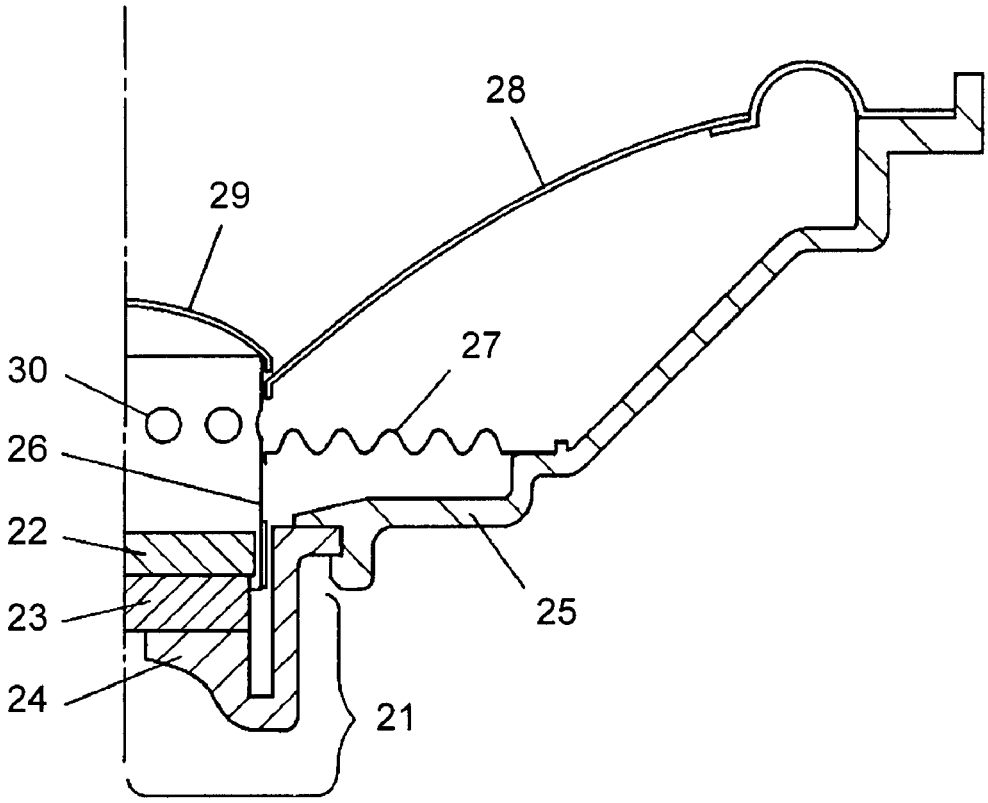

SPEAKER

This application is a U.S. National Phase Application of PCT International Application PCT/JP2006/300689, filed Jan. 19, 2006.

TECHNICAL FIELD

The present invention relates to a speaker that is used in a variety of acoustic equipment.

BACKGROUND ART

There is a speaker in which an opening is formed in a bobbin of a voice coil. Such a speaker according to a related art will be described with reference to a side sectional view of FIG. 4.

Referring to FIG. 4, magnetic circuit 21 is configured by adhesively coupling plate 22, magnet 23, and yoke 24. Voice coil 26 is supported by damper 27 so as to be moved up and down. Vibrating plate 28 is formed such that an inner circumference is coupled to voice coil 26 and an outer circumference is coupled to frame 25. Dust cap 29 for dustproofing is disposed in the center of vibrating plate 28. A bobbin of voice coil 26 has a plurality of openings 30 formed therein. When openings 30 reduce air spring in an inner space formed by voice coil 26, magnetic circuit 21 and dust cap 29, this allows the vibrating system to easily move.

Further, the influence of an acoustic circuit generated in the inner space is reduced to improve the sound quality such as articulation. Further, Japanese Patent Unexamined Publication No. 59-72298 is an example of prior art relating to this invention.

According to the above publication, in order to improve the operation of a speaker in which a magnetic fluid is filled in a magnetic gap, openings are provided in the bobbin of the voice coil. However, the openings are different from a typical bobbin opening.

Any of the typical bobbin opening shown in FIG. 4 and the bobbin opening disclosed in the above publication reduces not only the influence of the acoustic circuit inside the voice coil and the air spring during vibration, but also the air resistance. A full range speaker uses the air resistance as part of a damping force. Therefore, if the air damping is insufficient, abnormal sounds may frequently be generated during large vibrations. As a result, it is difficult to provide openings in the bobbin of the voice coil in order to reduce the influence of the acoustic circuit inside the voice coil in the speaker that uses air damping.

SUMMARY OF THE INVENTION

The speaker according to the present invention includes a magnetic circuit that is formed in the center of a frame, a voice coil that is inserted in a magnetic gap of the magnetic circuit, a damper that is fixed to the frame and the voice coil, and a vibrating plate that is fixed to the frame and the voice coil. An opening is provided in a bobbin of the voice coil, and the area of the opening is 0.3% or less of a radial cross-sectional area of the bobbin of the voice coil.

With this configuration, it is possible to reduce the influence of the acoustic circuit inside the voice coil in the speaker that uses the air damping and improve the sound quality while securing the required damping.

BRIEF DESCRIPTION OF THE DRAWINGS

FIG. 2 is a side sectional view of a voice coil of a speaker according to a second embodiment of the invention.

FIG. 3 is a sectional view of a state where a voice coil and a damper are coupled to each other in a speaker according to a third embodiment of the invention.

FIG. 4 is a half side sectional view of a speaker according to a related art.

DETAILED DESCRIPTION OF THE INVENTION

Hereinafter, embodiments of the invention will be described with reference to the drawings.

First Embodiment

Figure 1A:
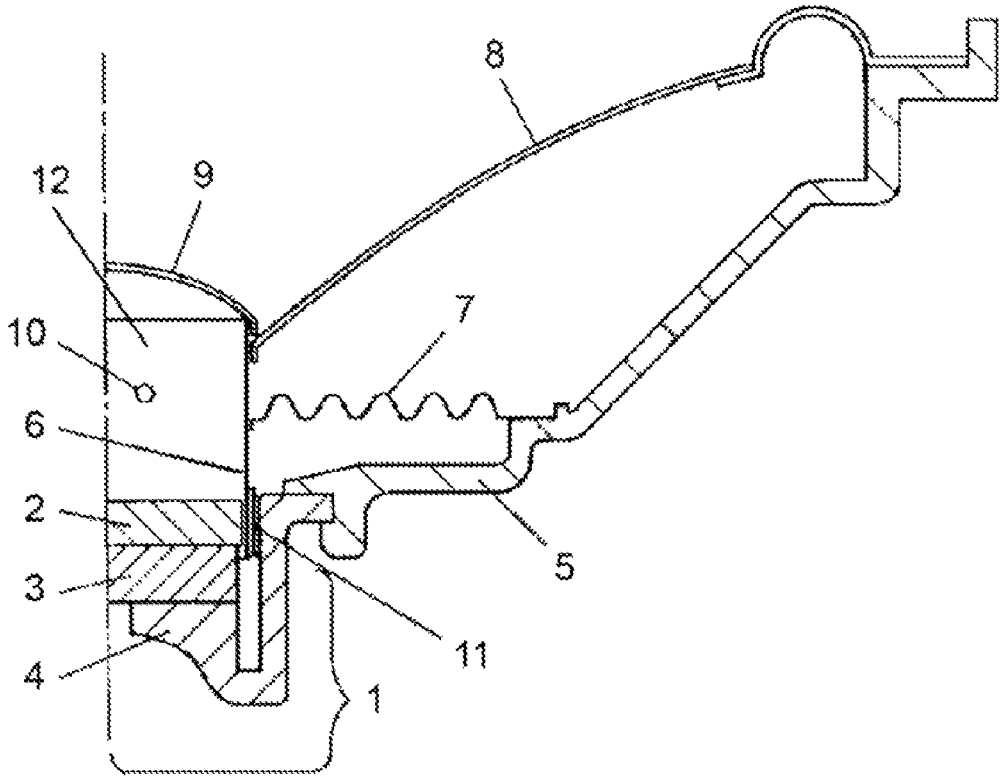
FIG. 1A is a half side sectional view of a speaker according to a first embodiment of the invention.
Figure 1B:
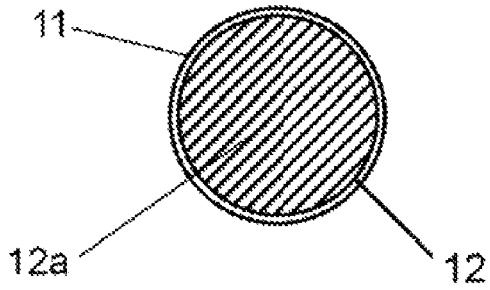
FIG. 1B is a radial sectional view of a voice coil of the speaker shown in FIG. 1A.

FIG. 1A is a half side sectional view of a speaker according to a first embodiment of the invention, and FIG. 1B is a radial sectional view of a voice coil of the speaker shown in FIG. 1A.

The speaker according to the first embodiment shown in FIG. 1A includes magnetic circuit 1 provided in the center of frame 5, voice coil 6 inserted in a magnetic gap of magnetic circuit 1, damper 7 fixed to frame 5 and voice coil 6, and vibrating plate 8 fixed to frame 5 and voice coil 6. Opening 10 is formed in bobbin 12 of voice coil 6. More specifically, as illustrated in FIG. 1A, the opening 10 is formed through the sidewall of bobbin 10 and, as shown in FIG. 1B, the sidewall of bobbin 10 is cylindrical. The area of opening 10 is 0.3% or less with respect to radial cross-sectional area 12*a* of bobbin 12 of voice coil 6 shown in FIG. 1B.

Further, the detailed configuration of the speaker according to the first embodiment will be described with reference to FIGS. 1A and 1B.

Magnetic circuit 1 is configured by plate 2, magnet 3, and yoke 4. Frame 5 is adhesively coupled to magnetic circuit 1. Vibrating plate 8 is formed such that an inner circumference is adhesively coupled to voice coil 6, and the outer circumference thereof is adhesively coupled to frame 5. Damper 7 is configured such that the inner circumference thereof is adhesively coupled to voice coil 6, and the outer circumference thereof is adhesively coupled to frame 5. Therefore, voice coil 6 is inserted in a magnetic gap of magnetic circuit 1 and supported so as to be moved up and down.

Dust cap 9 for dustproofing is provided in the center of vibrating plate 8. Opening 10 is formed in bobbin 12 of voice coil 6. Voice coil 6 has coil part 11 in which a coil is wound in a part of bobbin 12. The hatched portion of FIG. 1B indicates radial cross-sectional area 12*a* of bobbin 12 of voice coil 6.

Opening 10 penetrates the inner space of voice coil 6 and the outside thereof. The area of opening 10 is set so as to be 0.3% or less of radial cross-sectional area 12*a* of bobbin 12 of voice coil 6. The area of opening 10 is large enough to generate a large air resistance even when air passes through opening 10 when voice coil 6 moves up and down.

The upper limit of the area of opening 10 is 0.3% or less of radial cross-sectional area 12*a* of bobbin 12 of voice coil 6 as described above. However, the opening is such a size that the reduction in air damping due to opening 10 can be virtually ignored, suppresses the influence of the acoustic circuit occurring in the inner space formed by voice coil 6, magnetic circuit 1, and dust cap 9, and improves the sound quality.

The lower limit of the area of opening 10 is preferably set so as to reduce the air spring of the inner space formed by voice coil 6, magnetic coil 1, and dust cap 9 as compared with a case where opening 10 is not provided, and actually allows voice coil 6 to move up and down easily. Specifically, the area of opening 10 is preferably 0.05% or more of radial cross-sectional area 12*a* of bobbin 12 of voice coil 6.

Further, if a ratio of the area of opening 10 and cross-sectional area 12*a* of bobbin 12 of voice coil 6 is equal, it is possible to make a ratio of the amount of gas passage to the area of opening have uniform value during the same vibration. Therefore, even if the diameter of bobbin 12 of voice coil 6 is varied, it is easy to maintain the air damping by opening 10 to be constant.

As described above, according to the first embodiment, it is possible to realize both the air damping of voice coil 6 and the suppression of the influence of the acoustic circuit inside the voice coil.

Second Embodiment

FIG. 2 is a side sectional view of the voice coil of the speaker according to a second embodiment of the invention. Referring to FIG. 2, the difference from the first embodiment will be described. In FIG. 2, in a speaker according to the second embodiment, voice coil 13 has coil part 14 in which a coil is wound around a part of bobbin 120, and clearance gap 15 formed in a joint between the top of coil part 14 and bobbin 120 is blocked by a coating material.

Specifically, coil part 14 is formed by winding the coil around a border between coil part 14 and bobbin 120, that is, a part of bobbin 120, and then, clearance gap 15 that is present in a joint between coil part 14 and bobbin 120 is coated by the coating material such as varnish. Further, the size of opening 16 is set to be 0.3% or less of a radial cross-sectional area of bobbin 120 of coil part 13 as described above, which is the same as the first embodiment.

As described above, by using the coating, it is possible to suppress the influence of clearance gap 15 that is present in the joint between bobbin 120 and coil part 14 to stabilize the effect of opening 16.

Third Embodiment

FIG. 3 is a sectional view of a speaker in which a voice coil and a damper are coupled to each other according to a third embodiment of the invention. Referring to FIG. 3, the difference from the first embodiment will be described. In FIG. 3, opening 19 of bobbin 130 is provided between the top of coil part 20 of voice coil 17 and the bottom of adhered portion 140 of damper 18 at which the damper 18 is adhered to voice coil 17.

The third embodiment will be described in detail. In FIG. 3, the inner circumference of damper 18 is adhesively coupled to voice coil 17. Further, the outer circumference thereof is adhesively coupled to a frame that is not shown. Coil part 20 is formed such that a coil is wound around a part of bobbin 130. Voice coil 17 includes coil part 20 as bobbin 130.

Bobbin 130 of voice coil 17 has opening 19 formed therein. Opening 19 is provided between the top of coil part 20 of voice coil 17 and the bottom of damper adhered portion 140 in which the damper is adhered to voice coil 17.

Further, the size of opening 19 is set to be 0.3% or less of a radial cross-sectional area of bobbin 130 of voice coil 17 as described above, which is the same as the first embodiment.

According to the third embodiment with the above-described configuration, since opening 19 is formed below damper 18, it is possible to prevent extraneous matter from entering inside voice coil 17 by supplying or exhausting air through opening 19 when voice coil 17 is driven.

The invention is useful for a speaker that uses air damping by a voice coil to suppress the influence of the acoustic circuit inside the voice coil.

The invention claimed is:

1. A speaker comprising:

a frame;

a magnetic circuit that is formed in a radial center of the frame and has a magnetic gap;

a voice coil that is inserted in the magnetic gap of the magnetic circuit, the voice coil including a bobbin having a radial cross-sectional area;

a damper that is fixed to the frame and the voice coil; and a vibrating plate that is fixed to the frame and the voice coil;

wherein an opening is provided in the bobbin of the voice coil;

wherein the opening has an area equal to 0.3% or less of a radial cross-sectional area of the bobbin of the voice coil;

wherein a joint is formed between a top of a coil part of the voice coil and the bobbin;

wherein a clearance gap is formed at the joint between the top of the coil part of the voice coil and the bobbin; and wherein the clearance gap is blocked by a coating material.

2. The speaker of claim 1, wherein the damper is adhered to the voice coil by a damper adhered portion, and the opening of the bobbin is formed between a top of a coil part of the voice coil and a bottom of the damper adhered portion.

3. The speaker of claim 2, wherein the area of the opening is equal to 0.3% or less, and 0.05% or more, of the radial cross-sectional area of the bobbin of the voice coil.

4. The speaker of claim 1, wherein the area of the opening is equal to 0.3% or less, and 0.05% or more, of the radial cross-sectional area of the bobbin of the voice coil.

5. The speaker of claim 4, wherein the opening is formed through a sidewall of the bobbin.

6. The speaker of claim 4, wherein the bobbin of the voice coil has a cylindrical sidewall such that the radial cross-sectional area of the bobbin of the voice coil is circular; and the opening is formed through the cylindrical sidewall of the bobbin.

7. The speaker of claim 1, wherein the opening is formed through a sidewall of the bobbin.

8. The speaker of claim 1, wherein the bobbin of the voice coil has a cylindrical sidewall such that the radial cross-sectional area of the bobbin of the voice coil is circular; and the opening is formed through the cylindrical sidewall of the bobbin.

* * * * *

UNITED STATES PATENT AND TRADEMARK OFFICE

CERTIFICATE OF CORRECTION

PATENT NO. : 8,098,876 B2
APPLICATION NO. : 11/667112
DATED : January 17, 2012
INVENTOR(S) : Kiyoshi Yamagishi It is certified that error appears in the above-identified patent and that said Letters Patent is hereby corrected as shown below:

On the Title Page:

In item (86) PCT No.:

"PCT/JP2006/000689" should read --PCT/JP2006/300689--.

Signed and Sealed this
First Day of May, 2012

David J. Kappos

David J. Kappos
*Director of the United States Patent and Trademark Office*